US009802746B2

(12) United States Patent
Rhue

(10) Patent No.: US 9,802,746 B2
(45) Date of Patent: Oct. 31, 2017

(54) COMPOSITE CONTAINER WITH PEELABLE MEMBRANE

(71) Applicant: SONOCO DEVELOPMENT, INC., Hartsville, SC (US)

(72) Inventor: Elizabeth Rhue, Columbia, SC (US)

(73) Assignee: SONOCO DEVELOPMENT, INC., Hartsville, SC (US)

( * ) Notice: Subject to any disclaimer, the term of this patent is extended or adjusted under 35 U.S.C. 154(b) by 0 days.

(21) Appl. No.: 15/630,231

(22) Filed: Jun. 22, 2017

(65) Prior Publication Data

US 2017/0283149 A1 Oct. 5, 2017

Related U.S. Application Data

(63) Continuation of application No. 15/408,620, filed on Jan. 18, 2017, which is a continuation of application (Continued)

(51) Int. Cl.
*B65D 41/00* (2006.01)
*B65D 77/20* (2006.01)

(Continued)

(52) U.S. Cl.
CPC ..... *B65D 77/2044* (2013.01); *B65D 3/22* (2013.01); *B65D 17/502* (2013.01); *B65D 43/02* (2013.01); *B65D 2577/2033* (2013.01)

(58) Field of Classification Search
CPC .... B65D 17/502; B65D 3/22; B65D 77/2044; B65D 2577/2033; B65D 43/02; B31B 1/26

(Continued)

(56) References Cited

U.S. PATENT DOCUMENTS 3,946,872 A 3/1976 Sturm
4,280,653 A 7/1981 Elias (Continued)

FOREIGN PATENT DOCUMENTS

CN 1558827 12/2004
EP 0952087 10/1999

(Continued)

OTHER PUBLICATIONS

European Search Report for European Patent Application No. 15 175 851.3 dated Nov. 11, 2015, 7 pages.

(Continued)

*Primary Examiner* — Kareen Thomas
(74) *Attorney, Agent, or Firm* — Nelson Mullins Riley & Scarborough LLP

(57) ABSTRACT

A composite container is provided for holding products (e.g., stacked chips). The container includes a tubular body and a peelable membrane. The tubular body is made of at least one paperboard body ply having an inner surface and a metallized Oriented Polypropylene (mOPP) liner ply adhered to the inner surface of the paperboard body ply. A liner sealant is disposed on the inner surface of the mOPP liner ply, and the paperboard body ply and the mOPP liner ply are rolled outwardly to form a rim. The membrane, which has a membrane sealant on its inner surface, is sealed to the liner sealant in the area of the rim to close the container. When the membrane is peeled away, the membrane sealant and the liner sealant remain sealed to each other and cause separation within the mOPP liner ply, avoiding tearing and exposure of the paperboard in the rim.

10 Claims, 6 Drawing Sheets

Related U.S. Application Data

No. 14/328,305, filed on Jul. 10, 2014, now Pat. No. 9,611,069.

(51) Int. Cl.
*B65D 17/50* (2006.01)
*B65D 43/02* (2006.01)
*B65D 3/22* (2006.01)

(58) Field of Classification Search
USPC ..... 220/359.1, 359.3, 359.4, 359.2, 646, 220/495.01, 495.03; 229/123.1, 123.2, 229/5.5; 53/476, 477, 478, 461, 465; 156/69
See application file for complete search history.

(56) References Cited

U.S. PATENT DOCUMENTS

| | | | | |
|---|---|---|---|---|
| 4,372,460 | A | 2/1983 | Brochman et al. | |
| 4,381,848 | A * | 5/1983 | Kahn | B65D 77/2044 206/525 |
| 4,452,842 | A | 6/1984 | Borges et al. | |
| 5,415,910 | A | 5/1995 | Knauf | |
| 5,958,486 | A | 9/1999 | Ringdahl et al. | |
| 5,979,748 | A | 11/1999 | Drummond et al. | |
| 6,056,141 | A * | 5/2000 | Navarini | B32B 27/06 220/269 |
| 6,190,485 | B1 | 2/2001 | Cahill et al. | |
| 6,196,450 | B1 | 3/2001 | Varadarajan et al. | |
| 6,234,386 | B1 | 5/2001 | Drummond et al. | |
| 6,264,098 | B1 | 7/2001 | Drummond et al. | |
| 6,270,004 | B1 | 8/2001 | Drummond et al. | |
| 6,302,321 | B1 | 10/2001 | Reese et al. | |
| 6,460,720 | B1 | 10/2002 | Massey et al. | |
| 6,544,613 | B1 * | 4/2003 | Varadarajan | B65D 77/2032 220/359.1 |
| 6,857,561 | B2 | 2/2005 | Williams et al. | |
| 7,144,635 | B2 | 12/2006 | Hawes et al. | |
| 8,544,718 | B2 | 10/2013 | Yamato et al. | |
| 8,740,052 | B2 | 6/2014 | Drummond | |
| 8,746,490 | B2 * | 6/2014 | Huffer | B32B 27/32 156/247 |
| 2003/0178429 | A1 | 9/2003 | Williams et al. | |
| 2005/0031814 | A1 | 2/2005 | Dawes | |
| 2016/0009447 | A1 | 1/2016 | Rhue | |

FOREIGN PATENT DOCUMENTS

| | | |
|---|---|---|
| EP | 1477408 | 3/2001 |
| EP | 1477408 | 11/2004 |

OTHER PUBLICATIONS

European Office Action for European Patent Application No. 15 175 851.3 dated Jul. 19, 2016, 3 pages.
Office Action for Chinese Application No. 201510402006.6 dated Nov. 8, 2016, with English translation, 17 pages.
Office Action for Chinese Application No. 201510402006.6 dated Mar. 29, 2017, with English translation, 7 pages.
Office Action for U.S. Appl. No. 14/328,305 dated Jun. 14, 2016, 10 pages.
Final Office Action for U.S. Appl. No. 14/328,305 dated Sep. 8, 2016, 9 pages.
Notice of Allowance for U.S. Appl. No. 14/328,305 dated Nov. 25, 2016, 8 pages.
Office Action for U.S. Appl. No. 15/408,620 dated Apr. 19, 2017, 9 pages.
Notice of Allowance for U.S. Appl. No. 15/408,620, dated Jun. 5, 2017, 10 pages.

* cited by examiner

COMPOSITE CONTAINER WITH PEELABLE MEMBRANE

CROSS-REFERENCE TO RELATED APPLICATIONS

This application is a continuation of U.S. patent application Ser. No. 15/408,620, entitled "Composite Container with Peelable Membrane," filed Jan. 18, 2017, which is a continuation of U.S. patent application Ser. No. 14/328,305, entitled "Composite Container with Peelable Membrane," filed Jul. 10, 2014, each of which is incorporated by reference herein in its entirety.

BACKGROUND

The present disclosure relates to containers and methods for making such containers, and more particularly relates to composite containers wound from at least one paperboard body ply and a liner ply.

Food and drink products and other items are often packaged in composite containers that are sealed at both ends. A peelable membrane may be used at one of the ends to provide a consumer with access to the products contained inside. In conventional containers, achieving separation of the membrane from the container by peeling the membrane from the tubular container can sometimes be difficult or require excessive force to be applied by the consumer. In some cases, the separation of the membrane from the container partially destroys the opened end of the container and/or mars the aesthetic appearance of the opened end.

Accordingly, there is a need for a tubular container that is easier for a consumer to open and can be opened in an aesthetically pleasing way, while still providing an environment within the container that is acceptable for storing the products and is conducive to high volume, high speed manufacturing processes.

BRIEF SUMMARY

A composite container for products is thus described herein that is designed such that the paperboard in the rim of the container is left substantially intact upon peeling of the membrane to open the container. In one embodiment, the composite container includes a tubular body defining a first end and comprising at least one paperboard body ply having an inner surface and a metallized Oriented Polypropylene (mOPP) liner ply adhered to the inner surface of the at least one paperboard body ply. A liner sealant is disposed on an inner surface of the mOPP liner ply. The at least one paperboard body ply and the mOPP liner ply are rolled outwardly to form a rim at the first end of the tubular body, where the first end defines an opening providing access to an interior of the tubular body and the products held therein. The container further includes a peelable membrane for closing the tubular body to form the container. A membrane sealant is disposed on an inner surface of the membrane and is sealed to the liner sealant on the rim of the tubular body.

Upon peeling of the membrane from the tubular body to access the products via the opening, the membrane sealant and the liner sealant remain sealed to each other and cause separation within the mOPP liner ply to allow the membrane to be removed from the first end of the tubular member.

In some cases, the mOPP liner ply may comprise an outer mOPP layer, a core mOPP layer, and an inner mOPP layer. The separation within the mOPP liner ply may, in such cases, occur within the core mOPP layer. The mOPP liner ply may, in some embodiments, comprise a paper layer, a low density polyethylene (LDPE) tie layer, one or more mOPP film layers, and the liner sealant. The paper layer may be adhered to the paperboard body ply to fix the mOPP liner ply to the paperboard body ply. The liner sealant may comprise a metallocene linear low density polyethylene-high density polyethylene (mLLDPE-HDPE) coextrusion.

The peelable membrane may comprise at least one paper ply defining an inner surface, an adhesive tie layer disposed on the inner surface of the at least one paper ply, and a metalized polyethylene terephthalate (PET) film disposed between the at least one paper ply and the membrane sealant via the adhesive tie layer. The membrane sealant may be a 1.5 mil thick sealant film.

One or both of the liner sealant and the membrane sealant may comprise a high barrier film. The liner sealant may comprise a high barrier film with a moisture vapor transmission rate of less than 0.01 g/100 $in^2$/day and an oxygen transmission rate of less than 1.0 cc/100 $in^2$/day. The membrane sealant may comprise a high barrier film with a moisture vapor transmission rate of less than 0.01 g/100 $in^2$/day and an oxygen transmission rate of less than 0.02 cc/100 $in^2$/day.

In other embodiments, a method of manufacturing a composite container for holding products is described. According to embodiments of the method, a tubular body defining a first end is formed by providing at least one paperboard body ply having an inner surface and adhering a metallized Oriented Polypropylene (mOPP) liner ply to the inner surface of the paperboard body ply. The mOPP liner ply may comprise a liner sealant disposed on an inner surface of the mOPP liner ply. The at least one paperboard body ply and the mOPP liner ply may be rolled outwardly to form a rim at the first end of the tubular body. The first end may define an opening providing access to an interior of the tubular body and the products held therein. A peelable membrane may be attached to the first end of the tubular body to form the container, and a membrane sealant may be disposed on an inner surface of the membrane and may be sealed to the liner sealant on the rim of the tubular body.

Upon peeling of the membrane from the tubular body to access the products via the opening, the membrane sealant and the liner sealant should remain sealed to each other and cause separation within the mOPP liner ply to allow the membrane to be removed from the first end of the tubular member.

In some cases, the mOPP liner ply may comprise an outer mOPP film layer, a core mOPP film layer, and an inner mOPP film layer. Separation within the mOPP liner ply may occur within the core mOPP film layer. The mOPP liner ply may comprise a paper layer, a low density polyethylene (LDPE) tie layer, one or more mOPP film layers, and the liner sealant, and the paper layer may be adhered to the paperboard body ply to fix the mOPP liner ply to the paperboard body ply. The liner sealant may comprise a metallocene linear low-density polyethylene and high density polyethylene (mLLDPE-HDPE) coextrusion.

The membrane may be formed using at least one paper ply defining an inner surface, disposing an adhesive tie layer on the inner surface of the at least one paper ply, and placing a metalized polyethylene terephthalate (PET) film between the at least one paper ply and the membrane sealant via the adhesive tie layer. Each of the membrane sealant and the liner sealant may comprise a high barrier film.

The liner sealant may comprise a high barrier film with a moisture vapor transmission rate of less than 0.01 g/100 $in^2$/day and an oxygen transmission rate of less than 1.0 cc/100 in$^2$/day. The membrane sealant may comprise a high barrier film with a moisture vapor transmission rate of less than 0.01 g/100 in$^2$/day and an oxygen transmission rate of less than 0.02 cc/100 in$^2$/day.

The membrane sealant may be sealed to the liner sealant using punch-seal-overcapper equipment. Furthermore, the method may include spirally winding the paperboard body ply and the mOPP liner ply to form the tubular body.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

Figure 3:
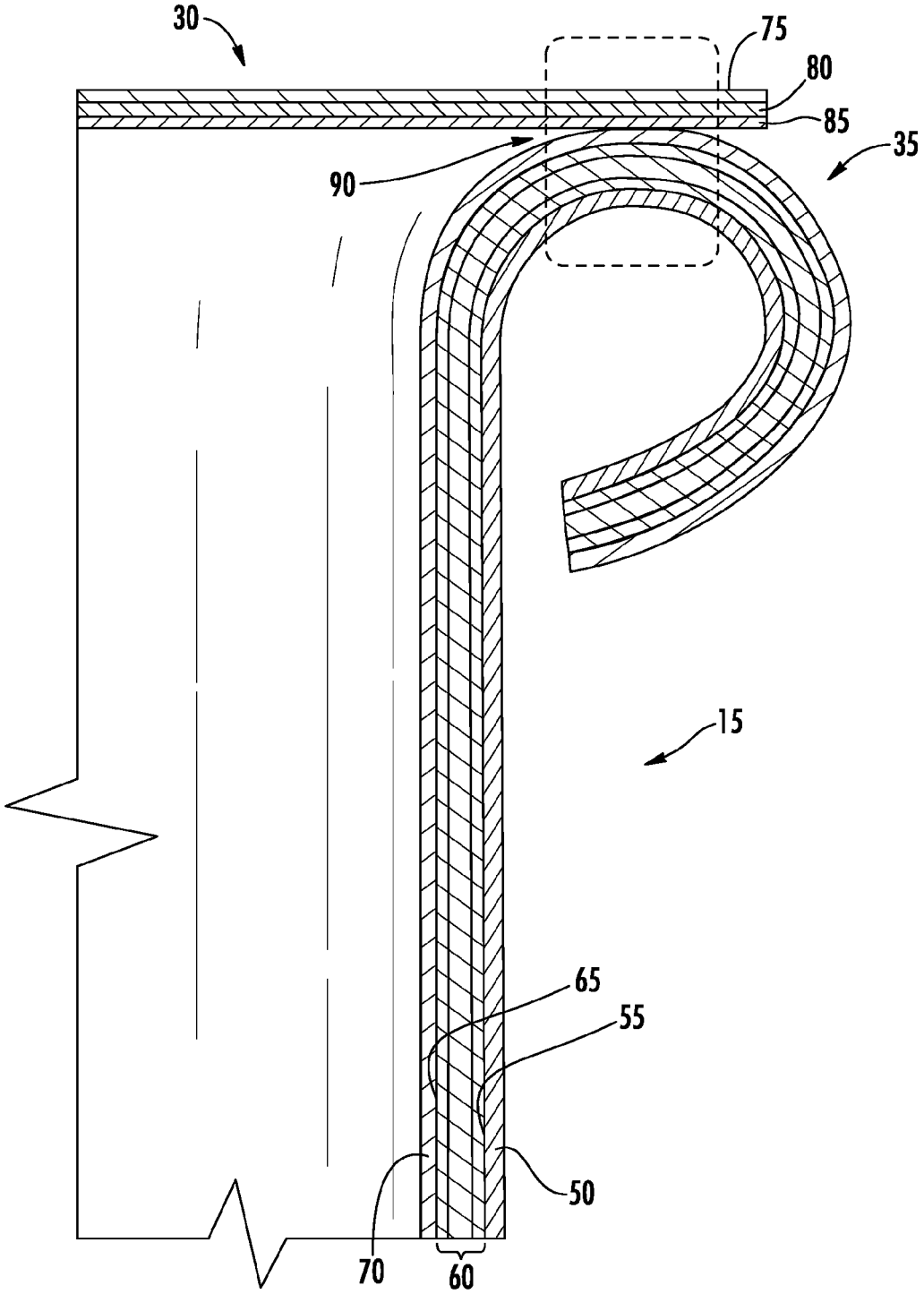
FIG. 3 is a cross-sectional view of a portion of the container of FIG. 1 showing a contact region with the liner sealant of the tubular body sealed to the membrane sealant of the membrane in accordance with an embodiment of the invention.
Figure 5:
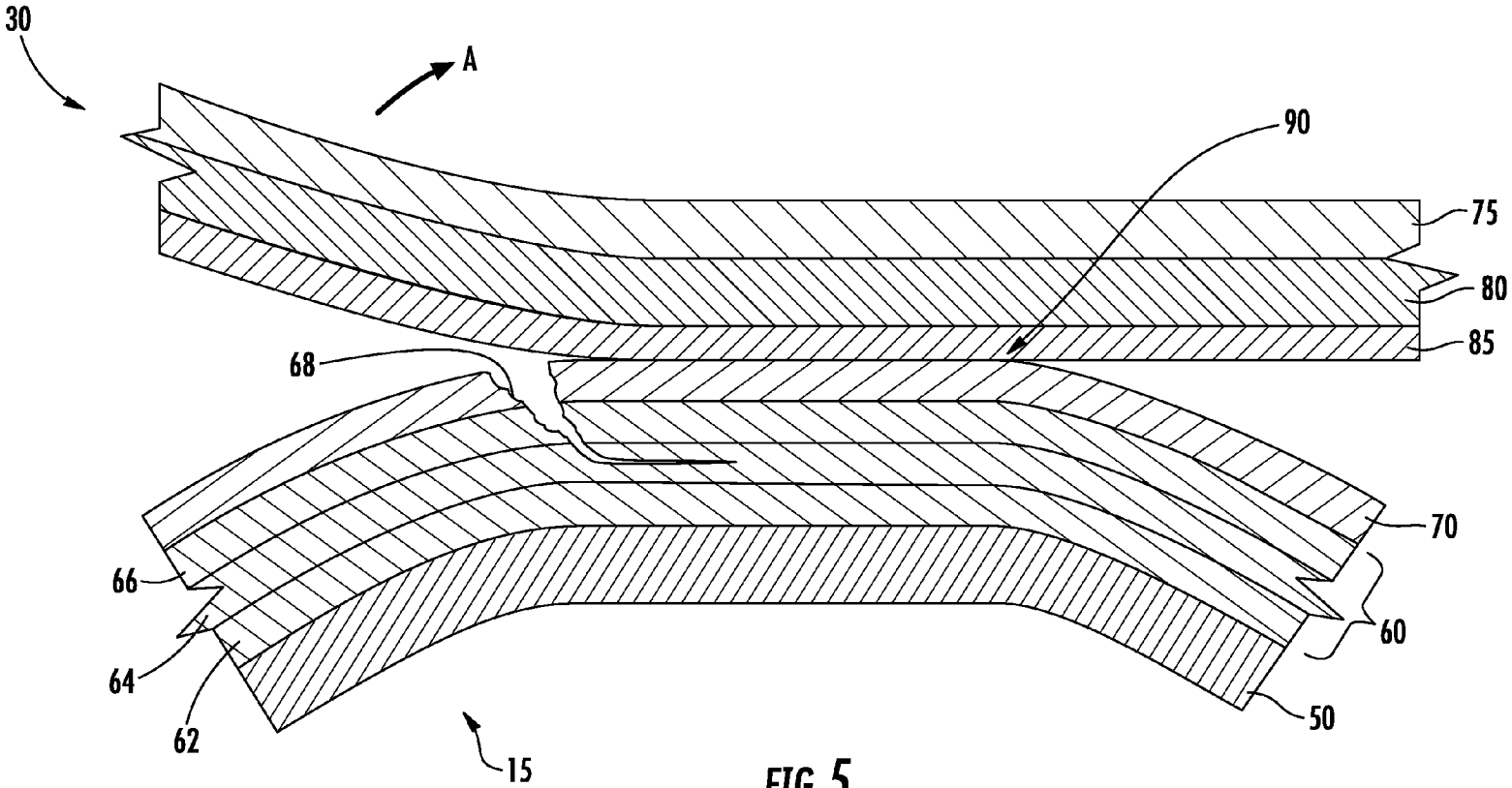
Figure 6:
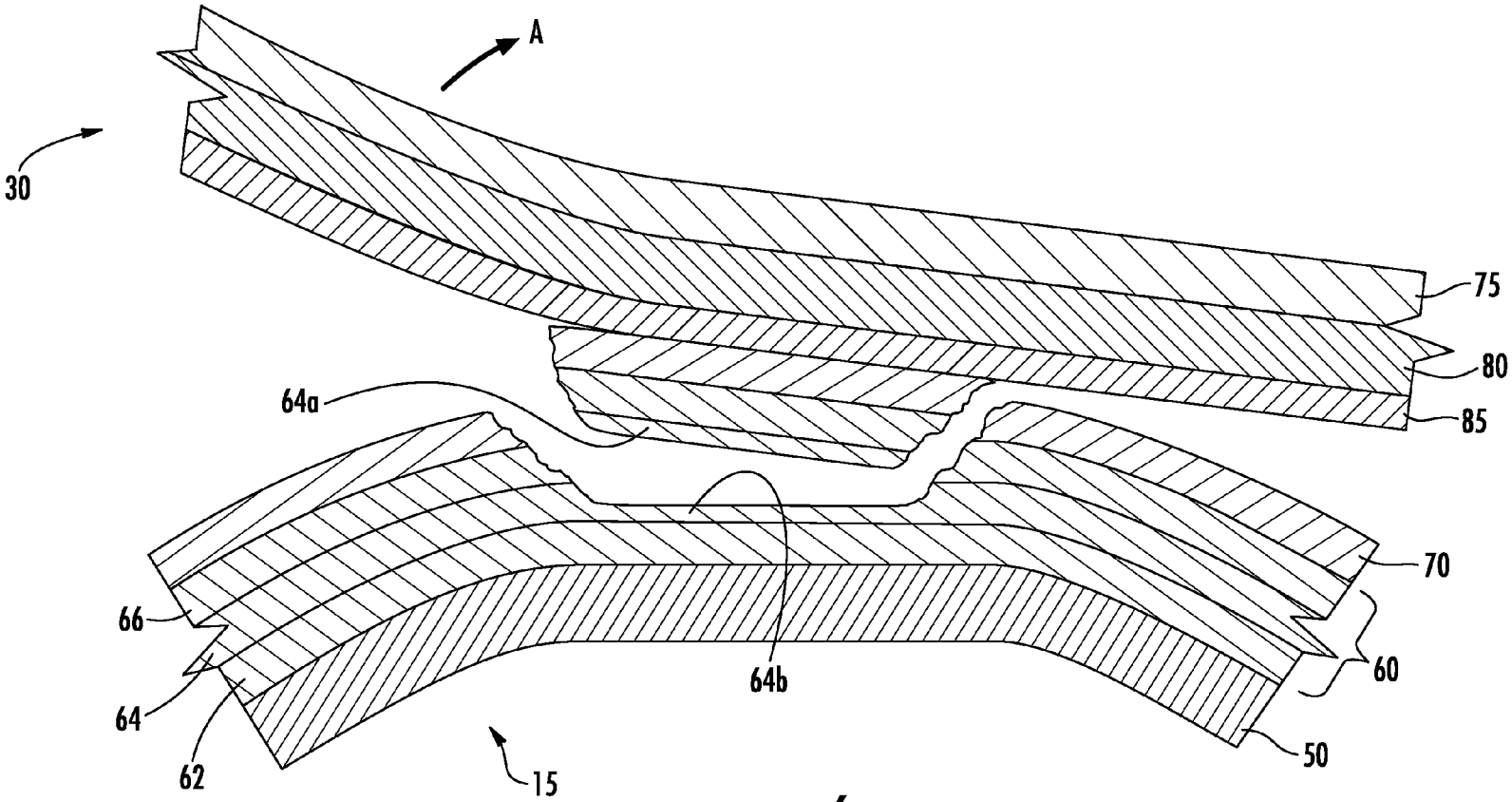

FIG. 5 is a close-up cross-sectional view of the contact region of FIG. 3 at a time after peeling of the membrane is initiated, but before the membrane is completely separated from the tubular body, in accordance with an embodiment of the invention; and FIG. 6 is a close-up cross-sectional view of the contact region of FIG. 3 at a time after the membrane is separated from the tubular body in accordance with an embodiment of the invention.

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Conventional composite cans are typically rigid, cylindrical containers that have a body made of layers of paper (e.g., paperboard) and ends made of metal or plastic. Composite cans are often used in the packaging of foods, such as coffee, spices, sugar, snacks (e.g., stacked chips), as well as for the packaging of non-foods, such as powders, cleaners, garden products, etc. Depending on the application (e.g., food or non-food), composite cans are generally required to meet certain requirements prior to being approved for use in that application. For example, in some cases, the composite can must be designed to function in high altitude, high temperature, and/or low temperature environments, while also providing a minimum specified shelf-life and requiring less than a predefined amount of force for a consumer to open the container and access the contents.

Conventional containers typically include a liner ply on the inner surface of the paperboard body ply. The liner ply prevents liquids, such as juices, from leaking out of the container and also prevents liquids (e.g., moisture) from entering the container and possibly contaminating the product contained therein. Preferably, the liner ply is also resistant to the passage of gases, so as to prevent odors of the product in the container from escaping and to prevent atmospheric air from entering the container and spoiling the product. Conventional liner plies most often include aluminum foil, which has good barrier properties and also has advantageous strength properties.

A membrane may be sealed to the foil liner and/or polymeric layers applied over the foil liner of the conventional container body, and an overcap may be provided in combination with the membrane to close the container until such time that the consumer wishes to gain access to the product inside. The seal between the membrane and the container body must be such that the product inside can attain a certain minimum shelf life and the container can remain sealed under different environmental conditions (e.g., high altitude and/or varying temperature extremes). At the same time, however, the seal cannot be so strong that an unreasonable amount of force (e.g., a force that would be found frustrating to apply by the average consumer) would be required to peel the membrane off for opening the container.

Thus, in conventional foil-based composite containers, the containers are configured such that once the consumer peels the membrane off the container to access its contents, the liner on the container body and foil layer are peeled away, exposing portions of the underlying paperboard. The tearing of portions of the paperboard that occurs as the membrane is peeled off may leave an unsightly brown rim on the open end of the container.

In an attempt to provide a container that is easy to open, while still providing the necessary protection for the product inside, and has a more aesthetic open end once the membrane is peeled away, the inventors have experimented with different types of materials, material thicknesses, material combinations and orientations, etc. to identify a design that meets both market and manufacturing requirements. Often, for example, membrane/liner combinations that were found to meet the requirements for shelf-life of the product required an unacceptably large amount of force to be opened by the consumer. Conversely, membrane/liner combinations that were easy for a consumer to open did not pass other stringent test requirements of the market or were not practical for manufacturing purposes (e.g., where the materials could not be processed on a manufacturing line at the required speeds for liner sealing and for membrane sealing).

After continued attempts to solve the problems described above, and through the application of hard work and ingenuity, the inventors have identified membrane/liner combinations, described below, that result in improved composite containers that address each of the problems identified above.

Figure 1:
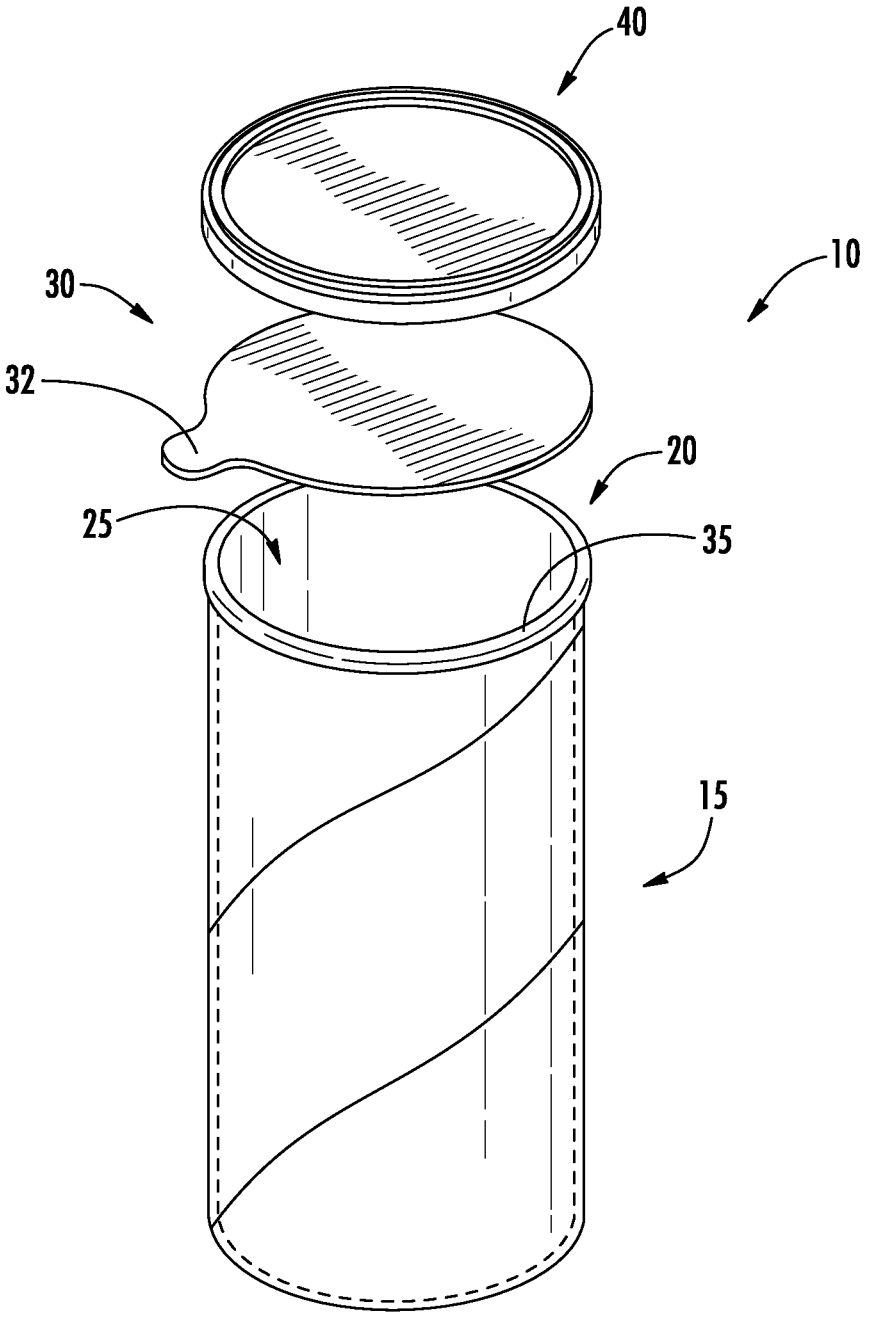
FIG. 1 is an exploded view of a composite container with an overcap in accordance with one embodiment of the invention.
Figure 2:
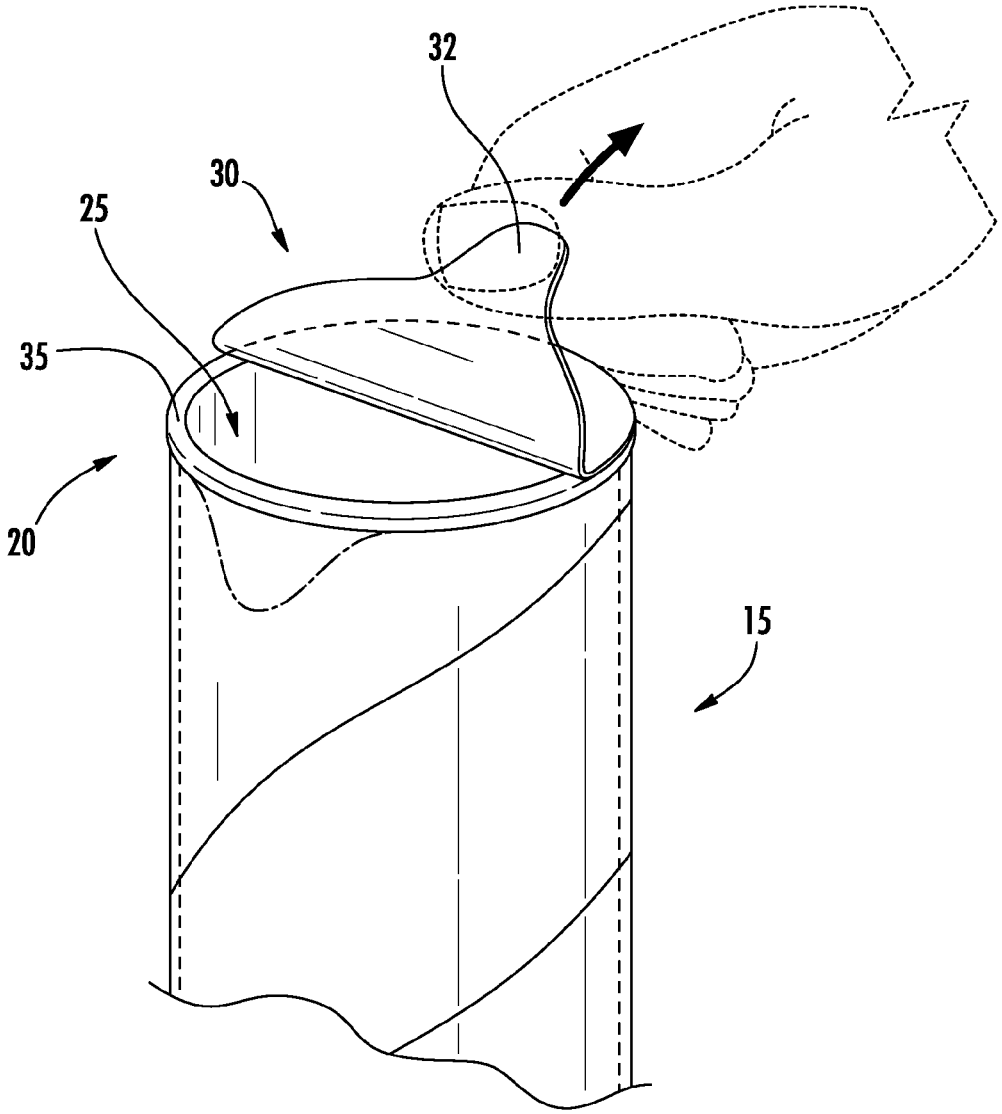
FIG. 2 illustrates the peeling of a membrane from the container of FIG. 1 in accordance with an embodiment of the invention.

Turning now to FIG. 1, a composite container 10 is shown according to embodiments of the invention. The composite container 10 may include a tubular body 15 having a first end 20 that defines an opening 25 providing access to an interior of the tubular body and the products held therein. The container 10 may further include a peelable membrane 30 for closing the tubular body 15 to form the container 10. With reference to FIG. 2, for example, the tubular body 15 may include a rim 35 at the first end 20, and the peelable membrane 30 may be sealed to the rim to close the container 10. In some embodiments, the peelable membrane 30 may include a pull tab 32, which may be a radially extending portion of or protrusion from the peelable membrane 30 that can be grasped by a user, as depicted in FIG. 2, and used to peel the peelable membrane 30 away from the tubular body 15 to gain access to the contents via the opening 25 that is created. In some cases, an overcap 40 may also be provided, as shown in FIG. 1, where the overcap is configured to engage the first end 20 of the tubular body 15 to cover the peelable membrane 30 before the membrane is removed. Once the membrane 30 is peeled away from the first end 20, the overcap 40 may also be used to directly engage the rim 35 of the first end 20 (e.g., via a friction fit) to reclose the container (e.g., if additional product remains inside the tubular body 15 for use at a later date).

As shown in FIG. 3, the tubular body 15 may comprise at least one paperboard body ply 50 having an inner surface 55. In some cases, for example, 1 or 2 (or more) plies of paperboard 50 may be spirally wound to form the tubular body 15. Recycled paperboard may, for example, be used in some applications. Moreover, in some cases, a paper label (not shown) may be applied to an exterior of the at least one paperboard body ply, such as to provide markings indicating the type of product, brand, manufacturer, ingredients, etc. relating to the product held therein.

A metallized Oriented Polypropylene (mOPP) liner ply 60 may be adhered to the inner surface 55 of the at least one paperboard body ply 50, such as via an adhesive (not shown) between the paperboard 50 and the mOPP liner ply 60. In some embodiments, the mOPP liner ply 60 may be a multilayer liner structure that includes a paper layer 61, a low density polyethylene (LDPE) tie layer (not shown) that holds one or more mOPP film layers 63 to the paper layer, and a liner sealant 70 disposed on an inner surface 65 of the mOPP film layers 63. The paper layer may be adhered to the inner surface 55 of the at least one paperboard body ply 50 to fix the mOPP liner ply 60 to the paperboard body ply. The mOPP liner ply 60 and the paperboard body ply 50 may be rolled together outwardly (e.g., with respect to the interior of the tubular body 15) to form the rim 35 at the first end 20 of the tubular body 15, as shown.

The peelable membrane 30, in turn, may also include multiple layers. For example, in some embodiments, the peelable membrane 30 may include at least one paper ply 75 and an intermediate layer 80 adhered to the paper ply. The intermediate layer 80 may be, for example a metalized polyethylene terephthalate (PET) film. An adhesive tie layer (not shown) may be disposed on an inner surface of the at least one paper ply 75 for affixing the intermediate layer 80 to the at least one paper ply 75. A membrane sealant 85 may be disposed on an inner surface of the membrane 30 (e.g., on an inner surface of the intermediate layer 80 in the depicted embodiment), such as via an adhesive. The membrane sealant 85, which may be a sealant film (e.g., an approximately 1-mil-thick to 2-mil-thick sealant film, such as an approximately 1.5-mil-thick sealant film), may be configured to be sealed or otherwise adhered or bonded to the liner sealant 70 of the tubular body 15 at a contact region 90 between the membrane 30 and the rim 35. The seal between the membrane sealant 85 and the liner sealant 70 may, for example, be the result of heat and/or pressure that is applied to the rim 35. A close-up view of the contact region 90 is shown in FIG. 4.

According to embodiments of the invention, one or both of the membrane 30 and the tubular body 15 may be configured (e.g., through the selection of materials, the ordering of the layers, the thickness of each layer, the type and/or amount of adhesive used between layers, etc.) such that upon peeling of the membrane 30 from the tubular body 15 to access the products via the opening (as illustrated in FIG. 2 and depicted in FIGS. 5 and 6), the membrane sealant 85 and the liner sealant 70 remain sealed to each other along the contact region 90 and cause a separation within the mOPP liner ply 60 that allows the membrane 30 to be removed from the first end 20 of the tubular member 15.

Figure 4:
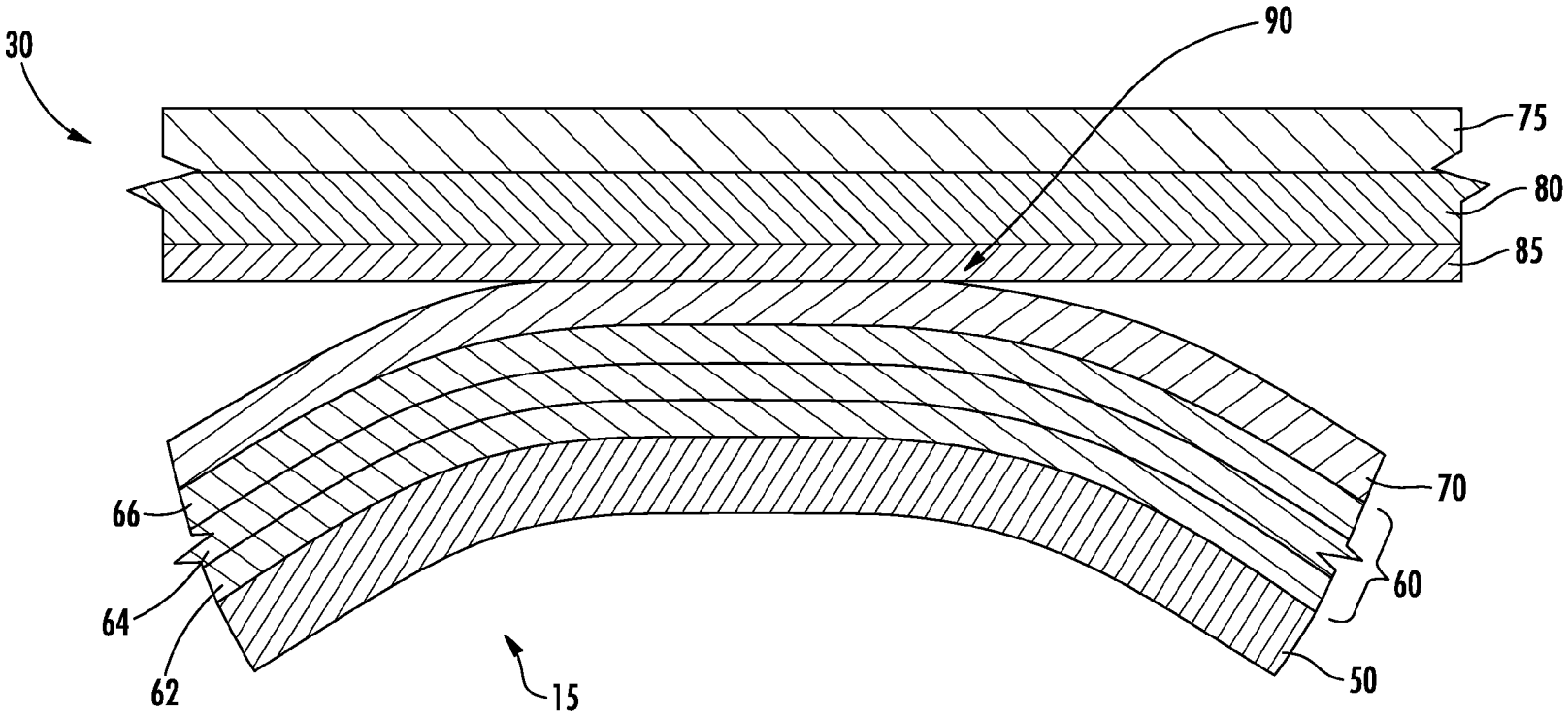
FIG. 4 is a close-up cross-sectional view of the contact region of FIG. 3 prior to the membrane being peeled in accordance with an embodiment of the invention.

In some embodiments, for example, the mOPP film layers 63 of the mOPP liner ply 60 may comprise an outer mOPP layer 62, a core mOPP layer 64, and an inner mOPP layer 66, as illustrated in FIGS. 4-6. The tubular body 15 and the membrane 30 may be configured such that separation within the mOPP liner ply 60 occurs within the core layer 64, as shown in FIGS. 5 and 6. In particular, once a threshold amount of force has been applied to the membrane 30 in a peeling direction A, a tear 68 may be initiated at the interface between the membrane sealant 85 and the liner sealant 70 at one end of the contact region 90. The threshold amount of force may be, for example, between approximately 4 lbs. and 12 lbs. of force, such as approximately 6-10 lbs. of force.

With the continued action of peeling off the membrane 30, the tear 68 may be propagated downward (e.g., in a generally cross-wise direction with respect to the arrangement of the layers) through the liner sealant 70, through the inner layer 66, and into (but not all the way through) the core layer 64. Upon further peeling of the membrane 30, the tear 68 may continue to be propagated, but in a direction that is generally aligned with the arrangement of the layers with respect to each other (e.g., generally horizontally with respect to the depicted embodiment of FIG. 5). The aligned portion of the tear 68 may continue along substantially the length of the contact region 90, as shown in FIG. 6, at which point the tear may be propagated upward (e.g., toward the liner sealant 70, in a generally cross-wise direction with respect to the orientation of the layers). As a result, a chunk that includes the liner sealant 70, the inner layer 66 of the mOPP ply 60, and a portion of the core layer 64 (depicted as portion **64*a* in FIG. 6) of the mOPP ply 60 may remain bonded with membrane sealant 85 and may be removed from the tubular member 15 as the membrane 30** is peeled off.

The portion of the core layer 64 (depicted as portion **64*b* in FIG. 6) that stays with the outer layer 62 and the at least one paperboard ply 50 may provide the rim 35 (shown, e.g., in FIG. 3) with a finished, clean appearance even after the membrane 30** has been peeled off. This is in contrast with conventional composite cans that use a foil layer in the membrane, the result of the peeling of which ends up removing the entire depth of the liner and tearing portions of the paperboard in the area where the membrane is sealed to the rim, causing the rim to have a rough, unfinished, and unsightly appearance.

As noted above, in some embodiments, the mode of separation described above and depicted in FIGS. 5 and 6 is brought about through the different materials, thicknesses, arrangements, etc. selected for the membrane 30 and the tubular member 15. For example, in some cases, the membrane sealant 85 and/or the liner sealant 70 may be polyethylene-based sealants. Additionally, the liner sealant 70 may comprise a metallocene linear low density polyethylene-high density polyethylene (mLLDPE-HDPE) coextrusion.

In some embodiments, at least one of the liner sealant 70 or the membrane sealant 85, and in some applications both sealants, may comprise a high barrier film. The high barrier film of the liner sealant 70 may, for example, have a moisture vapor transmission rate (MVTR) of less than 0.01 g/100 in$^2$/day and an oxygen vapor transmission rate (OTR) of less than 1.0 cc/100 in$^2$/day. The high barrier film of the membrane sealant 85 may have an MVTR of less than 0.01 g/100 in$^2$/day and an OTR of less than 0.02 cc/100 in$^2$/day.

A method of manufacturing a container for holding products, as described above, is also provided. Embodiments of the method may include forming a tubular body defining a first end by providing at least one paperboard body ply having an inner surface and adhering an mOPP liner ply to the inner surface of the paperboard body ply. The mOPP liner ply may include a liner sealant disposed on the inner surface of the mOPP liner ply, as described in greater detail above. The mOPP liner ply and the paperboard body ply may be rolled outwardly to form a rim at the first end of the tubular body, wherein the first end defines an opening providing access to an interior of the tubular body and the products held therein. The method may further include attaching a peelable membrane to the first end of the tubular body to form the container. A membrane sealant, as described above, may be disposed on an inner surface of the membrane and may be sealed to the liner sealant on the rim of the tubular body. In this way, upon peeling of the membrane from the tubular body to access the products via the opening, the membrane sealant and the liner sealant may remain sealed to each other and cause separation within the mOPP liner ply to allow the membrane to be removed from the first end of the tubular member. In some embodiments, the mOPP liner ply may comprise an outer mOPP layer, a core mOPP layer, and an inner mOPP layer, and separation within the mOPP liner ply may occur within the core mOPP layer.

In some embodiments, the mOPP liner ply may comprise a paper layer, a low density polyethylene (LDPE) tie layer, one or more mOPP film layers, and the liner sealant, and the paper layer may be adhered to the paperboard body ply to fix the mOPP liner ply to the paperboard body ply, as described above. Additionally or alternatively, the liner sealant may comprise an mLLDPE-HDPE coextrusion.

In some cases, the peelable membrane may be formed by using at least one paper ply defining an inner surface, disposing an adhesive tie layer on the inner surface of the at least one paper ply, and placing a metalized PET film between the at least one paper ply and the membrane sealant via the adhesive tie layer.

At least one of the membrane sealant or the liner sealant (or, in some cases, both) may comprise a high barrier film. For example, in some cases, the liner sealant may comprise a high barrier film with an MVTR of less than 0.01 g/100 in$^2$/day and an OTR of less than 1.0 cc/100 in$^2$/day. Additionally or alternatively, the membrane sealant may comprise a high barrier film with an MVTR of less than 0.01 g/100 in$^2$/day and an OTR of less than 0.02 cc/100 in$^2$/day.

In some embodiments, the tubular body may be formed by spirally winding the paperboard ply (e.g., a single ply, two plies, or more) and the mOPP liner ply, such as by spirally winding continuous strips of the materials around a mandrel of a desired shape (e.g., a cylindrical mandrel) to create the tubular structure. The liner sealant may be disposed on an inner surface of the mOPP liner ply, as described above. At the downstream end of the mandrel, the tubular structure may be cut into discrete lengths, and the tubular body may be rolled outwardly to form the rim, as described above. Each discrete section of the tubular body (representing a container) may be fitted with at least one end cap (e.g., at an end opposite to the first end 20 shown in FIG. 1), although in some applications the tubular bodies may be shipped to a separate facility for application of the end cap. The membrane may be affixed to the first end of the tubular body by sealing the membrane sealant to the liner sealant using punch-seal-overcapper (PSO) equipment.

Although an example method of manufacturing a composite container according to embodiments of the invention is described above with reference to the figures, it is understood that the steps of manufacturing the container may vary in some cases. For example, the order in which certain manufacturing steps occurs may vary, and/or in some cases certain steps may be omitted, and others may be added. For example, in some cases, an outer paper label that includes markings identifying the product name, manufacturer, ingredients, etc., as described above, may be applied to the container.

Moreover, the accompanying figures are provided for explanatory purposes and may not show the different layers, plies, adhesives, labels, inks, and other components described above with respect to embodiments of the container. In addition, those components that are illustrated are not necessarily drawn to scale. Thus, certain layers that are shown as the same thickness or thinner than other layers may actually be thicker than other layers, and so on.

As described above, embodiments of the invention therefore provide a composite container that is configured to meet health, safety, market, and manufacturing requirements, while at the same time avoiding an unaesthetic or unappealing appearance of the open rim of the container. In contrast with conventional containers, in which peeling of the membrane creates a brown ring around the rim of the container where the paperboard is exposed, embodiments of the invention described above allows the liner sealant and the membrane sealant to remain sealed to each other as separation occurs within the mOPP liner ply, thereby leaving the open rim with a clean and finished look.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of manufacturing a composite container for holding products comprising:

forming a tubular body defining a first end by:

providing at least one paperboard body ply having an inner surface; and adhering a metallized Oriented Polypropylene (mOPP) liner ply to the inner surface of the paperboard body ply, wherein the mOPP liner ply defines an inner surface and an outer surface, and wherein the mOPP liner ply comprises a liner sealant disposed on the inner surface of the mOPP liner ply, wherein the at least one paperboard body ply and the mOPP liner ply are rolled outwardly to form a rim at the first end of the tubular body, wherein the first end defines an opening providing access to an interior of the tubular body and the products held therein; and attaching a peelable membrane to the first end of the tubular body to form the container, wherein a membrane sealant is disposed on an inner surface of the peelable membrane and is sealed to the liner sealant on the rim of the tubular body, wherein, upon peeling of the peelable membrane from the tubular body to access the products via the opening, the membrane sealant and the liner sealant remain sealed to each other and cause separation between the inner and outer surfaces of the mOPP liner ply to allow the peelable membrane to be removed from the first end of the tubular body.

2. The method of claim 1, wherein the mOPP liner ply comprises an outer mOPP film layer, a core mOPP film layer, and an inner mOPP film layer, and wherein separation within the mOPP liner ply occurs within the core mOPP film layer.

3. The method of claim 1, wherein the mOPP liner ply comprises a paper layer, a low density polyethylene (LDPE) tie layer, one or more mOPP film layers, and the liner sealant, and wherein the paper layer is adhered to the paperboard body ply to fix the mOPP liner ply to the paperboard body ply.

4. The method of claim 1, wherein the liner sealant comprises a metallocene linear low-density polyethylene and high density polyethylene (mLLDPE-HDPE) coextrusion.

5. The method of claim 1 further comprising forming the membrane using at least one paper ply defining an inner surface, disposing an adhesive tie layer on the inner surface of the at least one paper ply, and placing a metalized polyethylene terephthalate (PET) film between the at least one paper ply and the membrane sealant via the adhesive tie layer.

6. The method of claim 1, wherein each of the membrane sealant and the liner sealant comprises a high barrier film.

7. The method of claim 1, wherein the liner sealant comprises a high barrier film with a moisture vapor transmission rate of less than 0.01 g/100 $in^2$/day and an oxygen transmission rate of less than 1.0 cc/100 $in^2$/day.

8. The method of claim 1, wherein the membrane sealant comprises a high barrier film with a moisture vapor transmission rate of less than 0.01 g/100 $in^2$/day and an oxygen transmission rate of less than 0.02 cc/100 $in^2$/day.

9. The method of claim 1, wherein the membrane sealant is sealed to the liner sealant using punch-seal-overcapper equipment.

10. The method of claim 1 further comprising spirally winding the paperboard body ply and the mOPP liner ply to form the tubular body.

* * * * *